US006828294B2

(12) United States Patent
Kellar et al.

(10) Patent No.: US 6,828,294 B2
(45) Date of Patent: Dec. 7, 2004

(54) HIGH RETENTION SANITIZER SYSTEMS

(75) Inventors: Kenneth E. Kellar, Flemington, NJ (US); Joseph C. Richards, West Windsor, NJ (US); Crystal A. Nesbitt, Bridgewater, NJ (US)

(73) Assignee: FMC Corporation, Philadelphia, PA (US)

( * ) Notice: Subject to any disclaimer, the term of this patent is extended or adjusted under 35 U.S.C. 154(b) by 215 days.

(21) Appl. No.: 10/213,027

(22) Filed: Aug. 6, 2002

(65) Prior Publication Data

US 2003/0109405 A1 Jun. 12, 2003

Related U.S. Application Data

(60) Provisional application No. 60/310,562, filed on Aug. 7, 2001, and provisional application No. 60/360,205, filed on Feb. 28, 2002.

(51) Int. Cl.[7] ..... C11D 3/48; C11D 9/50; C11D 1/00; C11D 10/00

(52) U.S. Cl. ..... 510/382; 510/536

(58) Field of Search ..... 510/382, 535, 510/536

(56) References Cited

U.S. PATENT DOCUMENTS

| | | | |
|---|---|---|---|
| 4,430,237 | A | 2/1984 | Pierce et al. |
| 4,853,146 | A | 8/1989 | Rorig et al. |
| 5,597,791 | A | 1/1997 | Richards et al. |
| 5,632,676 | A | 5/1997 | Kurschner et al. |
| 5,720,983 | A | 2/1998 | Malone |
| 5,855,217 | A | 1/1999 | John |
| 5,922,664 | A | 7/1999 | Cao et al. |
| 6,010,729 | A | 1/2000 | Gutzmann et al. |
| 6,054,424 | A | 4/2000 | Ip |
| 6,103,286 | A | 8/2000 | Gutzmann et al. |
| 6,113,963 | A | 9/2000 | Gutzmann et al. |
| 6,150,318 | A | 11/2000 | Silvester et al. |
| 6,183,807 | B1 | 2/2001 | Gutzmann et al. |
| 6,257,253 | B1 | 7/2001 | Lentsch et al. |
| 6,294,186 | B1 | 9/2001 | Beerse et al. |

FOREIGN PATENT DOCUMENTS

| | | |
|---|---|---|
| EP | 733 097 | 10/1998 |
| EP | 1 166 825 | 1/2002 |

OTHER PUBLICATIONS

"Foam Rapidly Degrades Chemical/Biological Warfare Agents," Chemical & Engineering News (77)10, Mar. 8, 1999.

"Foam for Mitigation and Decontamination of Chemical and Biological Weapons Agents," Tadros et al.; National Technical Information Service (47)1337, Nov. 21, 2000.

PCT International Search Report of Aug. 6, 2002.

"The Surface Viscosity of Detergent Solutions as a Factor in Foam Stability." A.G. Brown, William C. Thuman & J.W. McBain, Journal of Colloid Science (8)491–507, 1953.

"Interaction of Anionic Detergents and Certain Polar Aliphatic Compounds in Foams and Micelles." W.M. Sawyer & F.M. Fowkes, Journal of Physical Chemistry (62)159–166, 1958.

"Foam Stabilizing Additives for Synthetic Detergents. Interaction of Additives and Detergents in Mixed Micelles." M.J. Schick & F.M. Fowkes, Journal of Physical Chemistry (61)1062–1068, 1957.

"Minima In–Surface Tension–Concentration Curves of Solutions of Sodium Alcohol Sulfates." Gilbert D. Miles & Leo Shedlovsky, Journal of Physical Chemistry (48) 57–62, 1944.

"Surface Tensions of Aqueous solutions of Two Foam–Fractionated Detergents." A.P. Brady, Journal of Physical Chemistry (53) 56–66, 1949.

*Primary Examiner*—Mark Kopec
*Assistant Examiner*—John M Petruncio
(74) *Attorney, Agent, or Firm*—FMC Corporation

(57) ABSTRACT

An aqueous composition suitable for use as a high-retention sanitizer, especially on irregular and/or non-horizontal surfaces and surfaces on which water does not readily spread, a method for sanitizing a surface using the composition, and kits comprising components of the composition. The composition contains an organic peracid, preferably peracetic acid, or other antimicrobial agent, and a retention aid. The retention aid preferably is provided as a concentrate for admixture with the antimicrobial agent at point of use and comprises a mixture of a non-ionic surfactant, an ionic surfactant, and optionally a water-soluble magnesium ion source; or a mixture of a biopolymer thickening agent and at least one surfactant, and optionally a water-soluble magnesium ion source. In either retention aid, the magnesium ion source stabilizes foams formed from the retention aids in hard water and maintains retention aidconcentrates in a liquid state at room temperature if one of the surfactants is sodium lauryl sulfate, or magnesium lauryl sulfate or mixture thereof. The composition is preferably applied as a foam to the surface of the object to be sanitized.

35 Claims, No Drawings

HIGH RETENTION SANITIZER SYSTEMS

This application claims benefit of Provisional application Ser. No. 60/310,562 filed Aug. 7, 2001 and claims benefit of Provisional application Ser. No. 60/360,205 filed Feb. 28, 2002.

FIELD OF THE INVENTION

This invention relates to a high-retention sanitizer composition that can be applied to surfaces in a variety of forms. In particular, this invention relates to aqueous sanitizer compositions comprising one or more antimicrobial agents, characterized by improved retention time on surfaces to be sanitized.

BACKGROUND OF THE INVENTION

Aqueous solutions of antimicrobial agents such as lower organic peracids, especially those comprising peracetic acid, are effective as sanitizer compositions against a wide spectrum of microorganisms, including algae, fungi, bacteria, and viruses. However, because both concentrated and dilute solutions of lower organic peracids have a viscosity close to that of water, i.e., about 1 centipoise (cP), the solutions are not retained when applied to certain irregular and/or non-horizontal surfaces. On surfaces on which water does not readily spread, such as stainless steel, plastic, and foods such as vegetable produce and fruits, and the fatty regions of animal carcasses, the sanitizer composition tends to bead up and run off, instead of spreading uniformly over the surface. If the retention time of the sanitizer composition with the surface could be increased and the sanitizer composition were to spread evenly over the surface instead running off, the effectiveness of the sanitizer composition should be increased.

Because peracid and other antimicrobial solutions are frequently used as sanitizer compositions for food and for food machinery, as well as on non-food contact surfaces, it is essential that the method of increasing the contact time be non-toxic and environmentally friendly. In addition, the method of increasing the retention time should not catalyze decomposition of the antimicrobial agent or otherwise adversely affect its ability to sanitize the surface to which it has been applied.

Retention time can be increased by increasing the viscosity of the solution. However, this normally requires the addition of large amounts of other materials, which increases the cost of the sanitizer composition. Thus, a need exists for a method of increasing the retention time of organic peracid and other antimicrobial agent containing sanitizer compositions on surfaces, especially on irregular and/or non-horizontal surfaces as well as on surfaces on which water does not readily spread, that does not use materials that are toxic or leave undesirable residues, that does not markedly affect the stability of the antimicrobial agent, and that does not greatly increase the cost of the sanitizer composition.

SUMMARY OF THE INVENTION

In one aspect, the invention is an aqueous composition (A) suitable for use as a high-retention sanitizer composition, especially on irregular and/or non-horizontal surfaces as well as on surfaces on which water does not readily spread. The composition (A) comprises:

a) water;

b) about 1 ppm to about 3000 ppm of an antimicrobial agent; and c) a retention aid comprising about 0.01 wt % to about 3.0 wt % of a mixture of a non-ionic surfactant and an anionic surfactant; and, optionally, c) a magnesium ion source;

in which:

the non-ionic surfactant has a polar non-ionic group attached to a first alkyl having 8 to 20 carbon atoms;

the anionic surfactant has an anionic group attached to a second alkyl group having 8 to 20 carbon atoms; and the ratio of the non-ionic surfactant to the anionic surfactant is about 0.1:1 to about 0.4:1.

The first and second alkyl groups typically are straight chain alkyl groups substituted on the terminal carbon atom (1-position) with the polar non-ionic and anionic groups, respectively. Preferably, the first and second alkyl groups have substantially the same number of carbon atoms.

Another form of the sanitizer composition of the invention is a composition (B) comprising:

a) water;

b) about 1 ppm to about 3000 ppm of an antimicrobial agent;

c) a retention aid comprising (i) about 0.025 wt % to about 1.0 wt % of a biopolymer thickening agent and (ii) about 0.01 to 3.0 wt % of at least one surfactant; and, optionally, d) a magnesium ion source;

in which the composition has a viscosity of about 3 cP to about 15,000 cP. Suitable biopolymer thickening agents include polysaccharides and heterpolysaccharides as hereinafter described. The surfactants used in the retention aid of composition (B) may be the same or different from those used in the retention aid of composition (A).

In other aspects, the invention includes retention aid concentrates, packaging of the sanitizer composition as a multi-part kit, and a method for sanitizing a surface by application of the composition to the surface, for example, as a foam. In the kit, a first part may comprise an aqueous solution of the antimicrobial agent and a second part may comprise the retention aid concentrate.

In sanitizer compositions (A) and (B) the magnesium ion source may be magnesium ion from an anionic surfactant, if present, in excess of that required for surfactant functionality, or may be supplied separately by a magnesium salt different from the anionic surfactant, such as magnesium sulfate or other water soluble or dispersible magnesium compound. The magnesium ion source is useful for stabilizing foams when the sanitizer compositions contain or are applied in hard water and, in some embodiments of the invention, also assist in maintaining the surfactant system in a liquid state under use conditions.

In preferred embodiments of the invention, the magnesium ion source is present in the sanitizer compositions by addition to the retention aid concentrates, by preadmixture with any of the surfactants, or by addition to the sanitizer compositions when formed by admixture of the concentrates and antimicrobial agents, the latter especially respecting use of antimicrobial agents that are active at acidic pH. The magnesium ion source is added in an amount effective to stabilize resultant foams or films of the sanitizer compositions against degradation in the presence of hard water, for example when hard water is used to prepare, dilute or apply the sanitizer compositions.

The amounts of ingredients in the sanitizer compositions (A) and (B) are based on total weight of the compositions and represent compositions as used. However, as indicated above and as further described hereinafter, the compositions may also be prepared as concentrates for dilution at time of use, in which case the amounts of ingredients will be in ratios represented by the amounts described above but in higher concentrations.

Accordingly, a primary aspect of the invention is a high-retention aqueous sanitizer composition which can be applied to surfaces in a variety of forms: foams, films, fogs, and atomized or sprayed liquids. In preferred embodiments, respecting application as foams, unlike compositions that contain a single surfactant (which tend to be unstable, fall rapidly down a vertical surface, and fail to provide uniform coverage of the surface), the compositions of the invention are retained on the surface and provide more uniform surface coverage. High-retention provides a higher kill of microorganisms with a reduction in the amount of sanitizer composition used.

DETAILED DESCRIPTION OF THE INVENTION

In this specification and claims, unless the context indicates otherwise, all parts (including parts per million—ppm), percentages, and ratios are by weight, all temperatures are in ° C. and viscosities are in centipoise (cP) measured at 22° C. In the specification and claims, unless the context indicates otherwise, the terms "peracid", "surfactant", "alkyl alcohol", "alkyl sulfate", "antimicrobial agent", "biopolymer thickening agent" and other materials, include mixtures of two or more of these materials. Further, as used herein, the terms "sanitizer", "sanitizing agent", "antimicrobial agent", "disinfectant", "biocidal agent", and similar terms, are used interchangeably.

Similarly, as used herein, the terms "alkyl alcohol," "alkyl sulfate", "lauryl alcohol" and "sodium lauryl sulfate" also encompass the alkyl alcohols, alkyl sulfates, lauryl alcohols and sodium lauryl sulfates of commerce, and any mixtures found in commercial materials. For example, the lauryl alcohols of commerce may contain a mixture of analogous alkyl alcohols (i.e., 1-octanol, 1-decanol, 1-undecanol, 1-dodecanol, 1-tetradecanol, 1-hexadecanol, etc) with lauryl alcohol (1-dodecanol) predominating. A similar mixture of alkyl sulfates may be present in the sodium alkyl sulfates of commerce.

Antimicrobial Agents

Suitable antimicrobial agents for use in the sanitizer compositions of the invention include both organic and inorganic compounds, whether liquids or solids, known to control microbes and which can be applied in aqueous solution or dispersion. Examples are organic peracids, peracid generators, persulfates, peroxides, percarbonates, perchlorates, chlorine dioxide, hypochorous and hypochloric acid and their water soluble salts such as sodium hypochlorite, chlorine dioxide, phenolics, iodine, iodides, iodophors, and mixtures of any two or more thereof (including mixtures of species within a class of materials, for example, mixtures of different peracids or persulfates). The inorganic persulfates include sodium, potassium and ammonium persulfate, both in the mono and di forms where they exist. The peroxides include hydrogen peroxide and metal peroxides such as calcium peroxide and magnesium peroxide. Percarbonates include sodium and potassium percarbonate, and coated versions of the percarbonates as described in U.S. Pat. No. 5,194,176.

The description following relates to organic peracids, the preferred antimicrobial agents of the invention. Nevertheless, it is intended that all information contained therein, relating to amounts and ratios, is applicable to sanitizer compositions based on other antimicrobial agents.

Organic Peracids

"Peracid" and "organic peracid" refer to compounds of the structure RCOOOH in which R is an organic group. Although any organic peracid that has the requisite water solubility may be used in the sanitizer composition, a lower organic peracid is preferred. Lower organic peracid refers to the peracid of an organic aliphatic monocarboxylic acid having 2 to 10 carbon atoms (i.e., R is an organic group having from 1 to 9 carbon atoms), such as acetic acid (ethanoic acid), propionic acid (propanoic acid), butyric acid (butanoic acid), iso-buturic acid (2-methyl-propanoic acid), valeric acid (pentanoic acid), 2-methyl-butanoic acid, iso-valeric acid (3-methyl-butanoic acid), 2,2-dimethyl-propanoic acid, octanoic acid, nonaoic acid, and decanoic acid. Organic aliphatic peracids having 2 or 3 carbon atom are preferred. The most preferred organic peracid is peracetic acid, $CH_3COOOH$.

Mixtures of organic peracids may be used. For example, peracetic acid may be mixed with other lower organic acids and their corresponding peracids, such as with one or more peracids derived from aliphatic monocarboxylic acids having 3 to 10 carbon atoms (i.e. aliphatic monocarboxylic peracids having 3 to 10 carbon atoms), for example, perhexanoic acid, perheptanoic acid, per(2-ethyl)hexanoic acid, peroctanoic acid, pernonaoic acid, and/or perdecanoic acid. A preferred peracid for use with peracetic acid is peroctanoic acid ($C_7H_{15}COOOH$).

Reagents which generate peracids may also be used as antimirobial agents in the invention. These include 1,1,5-triacetoxypent-4-ene, 1,1,5,5-tetraacetoxy pentane, corresponding butene and butane compounds, ethylidene benzoate acetate and bis (ethylidene acetate) adipate, and the like, as described, for example, in European Patent 125781 published Nov. 21, 1984.

Organic peracids are formed from the corresponding organic acids and hydrogen peroxide by the following equilibrium reaction:

$$RCOOH + H_2O_2 \rightleftharpoons RCOOOH + H_2O. \quad \text{(I)}$$

The equilibrium concentration of each reagent can be calculated from the equilibrium equation:

$$\frac{[RCOOOH][H_2O]}{[RCOOH][H_2O_2]} = K_{ap} \quad \text{(II)}$$

where:

[RCOOOH] is the concentration of peracid in mole/L;

$[H_2O]$ is the concentration of water in mole/L;

[RCOOH] is the concentration of organic acid in mole/L;

$[H_2O_2]$ is the concentration of hydrogen peroxide in mole/L; and $K_{ap}$ is the apparent equilibrium constant for the peracid equilibrium reaction (Equation I).

The apparent equilibrium constant, $K_{ap}$, is dependent on the peracid chosen and the temperature. Equilibrium constants for peracid formation are discussed in D. Swern, ed., *Organic Peroxides*, Vol. 1, Wiley-Interscience, New York, 1970. For peracetic acid at a temperature of 40° C., the apparent equilibrium constant is about 2.21. Thus, organic peracid solutions also comprise hydrogen peroxide and the organic acid or acids corresponding to the organic peracid or peracids present in the solution.

In dilute solutions a relatively long period of time is required to attain equilibrium because of the low concentration of the reactants. Consequently, peracids are typically prepared in concentrated solution and then diluted to the required concentration prior to use. Equilibrium solutions that comprise about 5% peracetic acid typically comprise about 22% hydrogen peroxide. Equilibrium solutions that comprise about 15% peracetic acid typically comprise about 10% hydrogen peroxide. When these equilibrium solutions are diluted to solutions that comprise about 50 ppm of PAA, the solution produced by dilution of the 5% PAA solution comprises about 220 ppm of hydrogen peroxide, and the solution produced by dilution of 15% solution comprises about 33 ppm of hydrogen peroxide.

A catalyst, added to reduce the time required for the organic peracid to reach equilibrium, may be present. Typical catalysts are strong acids, such as, sulfuric acid, sulfonic acids, phosphoric, and phosphonic acids. When the peracid solution is diluted to produce the desired peracid level, the catalyst is also diluted. The presence of low levels of sulfuric acid, for example concentrations in the range of about 1 ppm to about 50 ppm, does not adversely affect the properties of the sanitizer composition.

Commercial organic peracid solutions typically contain a sequestering agent that chelates metals that catalyze the decomposition of hydrogen peroxide. These include, for example, pyridine carboxylates and organic phosphonic acids capable of sequestering bivalent metal cations, as well as the water-soluble salts of such acids. A common chelant is 1-hydroxyethylidene-1,1-diphosphonic acid, which is sold as DEQUEST® 2010 sequestering system. The low levels of chelants present in the sanitizer composition after dilution do not significantly affect the properties of the composition.

The use concentration of peracid or mixture of peracids in the sanitizer composition may be in the range of about 1 ppm to about 3000 ppm, typically at least about 100 ppm However, in one aspect of their use, the retention aids of the invention give the organic peracid a longer retention time on the surface to be sanitized and therefore will require less organic peracid. Accordingly, concentrations of peracid or mixtures of peracids in the sanitizer compositions may be about 25 ppm by weight to about 2600 ppm, preferably about 75 ppm to about 1000 ppm, even more preferably about 85 ppm to about 300 ppm.

While the organic peracid may be applied with use of surfactant to assist spreading on a surface and for better retention, application with a retention aid that is foamable allows higher organic peracid concentrations to be used. This is because diffusion of gases occurs slower in foams and because the amount of liquid containing the organic peracid is released in smaller amounts from the foam. Since the foams resulting from the retention aids disclosed herein are particularly stable, the diffusion of irritating vapors of the organic peracid and the drainage of the liquid component containing the organic peracid will be reduced to an even greater extent than for most other foams. Consequently, the organic peracid can be applied at a higher concentration than when a foam is not used. Use of a higher organic peracid concentration will be extremely useful when applied to surfaces that are not or cannot be cleaned sufficiently to adequately remove organic load. When the organic load is high, the organic peracid will be used up due to a reaction with the organic load, leaving less organic peracid to act as a biocide.

However, the application of organic peracids, particularly peracetic acid (PAA), at high concentrations (greater than 100 ppm), is sometimes deemed undesirable due to a strong odor and to irritating vapors. Consequently, PAA is not typically used in open areas at concentrations greater than 100 ppm. Nevertheless, in accordance with the present invention, it has been found that use of PAA at concentrations higher than 100 ppm is possible, when applied as a foam (using a retention aid as described herein) because such foam inherently reduces the PAA vapors released into the air. The preferred range of organic peracid or mixed peracid concentration for this application is about 25 to about 3000 ppm, more preferably about 85 to 3000 ppm.

Retention Aids

The sanitizer compositions (A) and (B) of the invention contain retention aids comprising certain surfactants, or combinations of surfactant with a biopolymer thickener, that facilitate formation of foams. Two requirements must be met for a foam to be retained and to spread evenly over the surface. The foam itself needs to be stable, that is, the foam cannot break apart in a short period of time. In addition, the foam needs to adhere to the surface and not quickly fall off of the surface after it is applied. The retention aids of the invention satisfy these requirements.

Although single surfactants or mixtures of surfactants can produce a foam and reduce the surface tension of the solution enough to allow spreading on the surface, these foams are rarely stable. As a result, in addition to the surfactant, a foam stabilizer must be added. However, although producing a stable foam is a necessary condition for a high-retention system, it is inadequate by itself. The foam must also adhere to the surface and not fall quickly off the surface after it is applied. This means that the surface of the liquid film of the foam must be elastic, preferably plastic, enough to prevent a rapid passage of water to the surface (which would cause the foam to either slip off the surface or retract). However, the surface of the film cannot be too plastic or else the diffusion of the peracid from the liquid film to the surface will be impeded, thereby reducing the efficacy of the antimicrobial agent.

Although certain surfactant pairs that produce foams having some plasticity on surfaces are known, for example, a lauryl alcohol/lauryl sulfate system (A. G. Brown, W. C. Thuman, J. W. McBain, *J. Colloid. Sci.* 8, 491–507 (1953)) and a cetyl alcohol/cetyl sulfate system (A. P. Brady, *J. Phys. Chem.* 53, 56–66 (1949)), it is necessary that the surfactant pair be a composition that produces a sanitizer foam that is sufficiently elastic (plastic) to allow for a long retention time on the surface, yet not too plastic to interfere significantly with diffusion of the organic peracid or other antimicrobial agent to the surface to be sanitized.

The retention aid used in sanitizer composition (A) of the invention comprises a mixture of specific surfactants: an anionic surfactant and a non-ionic surfactant. The addition of the requisite non-ionic surfactant to a solution containing the anonic surfactant converts the surface into a closer-packed array of surfactant molecules, thereby producing a more stable foam than would occur if the non-ionic surfactant were not present. The foam is more stable because the closer-packed array slows the drainage of liquid from the foam (thereby increasing retention time of the foam on a surface as well as increasing lifetime of the foam) and slows the diffusion of gas out of the foam (thereby increasing the lifetime of the foam). When only an anionic surfactant is present, weak foams are typically formed which drain liquid and release gases rapidly, mainly because of the mutual repulsion of the polar head groups.

The requisite non-ionic surfactant has a polar non-ionic functional group, such as N-polar substituted amides, unsubstituted amides, glycerol ethers, sulfolanyl ethers, and primary alcohols—groups that have an ability to form hydrogen bonds with the adjacent ionic surfactant and water molecules, or have an ability to act as a polar buffer between the ionic groups of the surfactant molecules, thereby reducing the mutual repulsion of the ionic groups. Other examples include functional groups containing hydroxyl; methoxyl; carboxyl; amino, such as —$NH_2$, —$NH(CH_2CH_2OH)$, and —$N(CH_2CH_2OH)_2$; amide, such as —$CONH_2$, —$CONH(CH_2CH_2OH)$, and —$CON(CH_2CH_2OH)_2$; sulfonamide, such as —$SO_2NH_2$, —$SO_2NH(CH_2CH_2OH)$, and —$SO_2N(CH_2CH_2OH)_2$; carboxylic acid ester; and sulfonate ester. For sodium or magnesium lauryl sulfate, a preferred polar group is hydroxyl.

The polar non-ionic group is attached to an alkyl group of the non-ionic surfactant. The alkyl group of the non-ionic surfactant should be approximately the same length as the alkyl group of the anionic surfactant. Furthermore, the alkyl group of the non-ionic surfactant (and the alkyl group of the anionic surfactant) should be straight chain ("normal") and not branched. This is believed to contribute to a close-packed arrangement of surfactant molecules on the surface, leading to an increase in foam stability. The polar non-ionic group in the non-ionic and anionic surfactant preferably is attached to the terminal carbon atom (1-position). Preferably, the alkyl group of each surfactant contains 8 to 20 carbon atoms, more preferably 10 to 18 carbon atoms, even more preferably 11 to 16 carbon atoms. The most preferred alkyl group for each surfactant is a straight chain alkyl group, substituted in the 1-position, that contains twelve carbon atoms (i.e., the lauryl group).

Preferably, the alkyl group of the non-ionic surfactant (the first alkyl group) and the alkyl group for the anionic surfactant (the second alkyl group) have the same or substantially the same chain length, that is, the alkyl groups have the same number of carbon atoms or differ in chain length by not more than two carbon atoms. However, more disparity in chain length is possible as the alkyl groups become longer.

Similarly to the non-ionic surfactant, the anionic group of the anionic surfactant is attached to an alkyl group, preferably on a terminal carbon atom (1-position). The anionic group of the anionic surfactant is, for example, sulfate; sulfonate and benzene sulfonate; phosphate; carboxylate; and sulfosuccinate. A preferred anionic group is sulfate, and preferred anionic surfactants are salts of sulfate esters of linear aliphatic alcohols. Preferred cations for the anionic surfactants are potassium, ammonium, substituted ammonium salts, and more preferably, sodium and magnesium. Representative anionic surfactants include sodium dodecylbenzene sulfonate, and sodium and magnesium lauryl sulfate, and sodium and magnesium undecyl sulfate.

The ratio of the non-ionic surfactant to the anionic surfactant is about 0.1:1 to about 0.5:1. Preferably, the ratio is about 0.11:1 to 0.35:1. More preferably, the ratio is about 0.12:1 to 0.3:1. If the anionic surfactant is used alone in sanitizer composition (A) or the ratio is too low, the foam produced is not retained evenly on the surface. It will break apart and rapidly pull away from the edges and other places where there is an interface of the surface with air (such as door handles, hinges, etc.). For example, addition of one percent or less of lauryl alcohol to a solution containing about 0.2 percent sodium lauryl sulfate gives a stable, long-lasting foam (in comparison to sodium lauryl sulfate alone), but the foam does not adhere well to a vertical stainless steel surface. It falls down and breaks apart in a manner similar to the way a solution with only sodium lauryl sulfate alone would respond.

Preferred non-ionic surfactants are linear aliphatic alcohols that have 8 to 20 carbon atoms. Preferably, the ionic surfactant is the salt of a sulfate ester of a straight chain alkyl alcohol that has 8 to 20 carbon atoms. Sodium and magnesium salts are preferred. More preferred anionic surfactants are sodium or magnesium lauryl sulfate and sodium or magnesium undecyl sulfate. Preferred surfactant pairs are lauryl alcohol/sodium lauryl sulfate; lauryl alcohol/sodium lauryl sulfate; cetyl alcohol/sodium cetyl sulfate; lauryl ethanolamide/sodium dodecylbenzene sulfonate; and lauryl alcohol/magnesium lauryl sulfate. The preferred ratio of lauryl alcohol to sodium lauryl sulfate (or magnesium lauryl sulfate) is about 0.12:1 to 0.3:1, more preferably about 0.125:1 to 0.2:1. Sanitizer compositions that comprise the lauryl alcohol/sodium lauryl sulfate stabilizer system are active for at least several days with respect to PAA concentration.

The retention aids of the sanitizer compositions (A) and (B) comprise about 0.01 wt % to about 3.0 wt % of the surfactant or surfactants, preferably about 0.05 wt % to about 2.0 wt %, more preferably about 0.1 wt % to about 0.5 wt %. It is preferred to use the lowest concentration of retention aid in the sanitizer compositions that provides both a stable foam (that will be retained by a surface such as a wall), and the desired sanitizing effect. For example, the concentration of retention aid should be high enough that the surface tension of the sanitizer composition is reduced to the point at which the sanitizer composition spreads over the surface to which it has been applied. For use of the sanitizer compositions on stainless steel surfaces, the surface tension of the sanitizer composition should be reduced to about 35 dynes/cm or less. The retention aids of the invention can reduce the surface tension of the sanitizer composition to about 25 dynes/cm or less.

Because it is preferred that the alkyl group of the non-ionic surfactant (the first alkyl group) and the alkyl group of the anionic surfactant (the second alkyl group) have substantially the same chain length, materials that have substantially a single chain length, i.e., materials that contain at least 90%, preferably at least 95% pure, and more preferably 97%, material of a single chain length, are preferred over materials that contain mixtures, such as certain commercially available materials the contain mixtures of analogous alkyl compounds. For food-related applications, i.e., sanitization of food and food-contact surfaces, food grade materials, such as food grade surfactants and biopolymer thickeners, should be used in the sanitizer composition.

When the sanitizer composition is prepared or applied in hard water, which typically contains both calcium and magnesium ions, little or no foaming may occur. We have observed that the loss of foaming ability for systems containing sodium lauryl sulfate is due to the presence of calcium ions, and not to magnesium ions, in the hard water.

Although the foaming ability of the sanitizer composition may be restored by the addition of various chelating agents, such as the sodium salts of ethylene diamine tetracetic acid (EDTA) or the sodium salts of diethylene triamine pentaacetic acid (DTPA), it was found that PAA rapidly decomposes in the presence of these materials. Although PAA was stable in the presence of DEQUEST® 2010, a large amount was required to restore foaming. This is likely due to the acidic pH of a solution containing PAA (pH of 4 for 85 ppm PAA), since the chelating ability decreases with decreasing pH due to protonation of the anionic functional groups. Although DEQUEST® chelators are used as sequestering agents in commercial PAA solutions, the affinity of the lauryl sulfate anions for calcium ions makes it even more difficult for these DEQUEST® chelators, or any other chelator, to sequester calcium ions at conditions of acidic pH.

It is known that magnesium lauryl sulfate is more soluble in hard water than sodium lauryl sulfate (Surfactants and Interfacial Phenomena, Milton J. Rosen, John Wiley & Sons, New York, 1978, p. 11), and would therefore provide better foaming in hard water. However, near stoichiometric amounts of magnesium ions (with respect to the lauryl sulfate (LS) anions, $Mg(LS)_2$) are not sufficient to overcome the sensitivity to water hardness for practical use conditions; eventually the magnesium counterions are replaced with calcium ions to form the insoluble calcium lauryl sulfate ($Ca(LS)_2$) thereby reducing the foaming ability. We found that by the addition of excess magnesium sulfate the LS anions and calcium ions most likely become surrounded by ions of opposite charges, the $Mg^{2+}$ ions and $SO_4^{2-}$ ions respectively, so that the LS anions and calcium ions are held in solution more strongly and thus are less likely to combine and form the insoluble $Ca(LS)_2$. This restores foaming without adversely affecting the concentration of PAA.

Although magnesium sulfate is used in Examples below, any magnesium salt having sufficient water solubility or dispersibility can be substituted, or the magnesium ions can be provided by an excess of magnesium lauryl sulfate over what is required for surfactant activity. Preferably, the magnesium source will be different from the magnesium lauryl sulfate—for example, it will be a magnesium salt such as magnesium sulfate, a hydrate of magnesium sulfate, or magnesium carbonate. Use of magnesium chloride or a hydrate of magnesium chloride is less preferred because chloride catalyzes the decomposition of stainless steel. For a sanitizer composition that contains (i) sodium lauryl sulfate, (ii) lauryl alcohol, and (iii) magnesium sulfate, these materials preferably are present, for example, in the ratio by weight percentages of 0.25:0.05:0.125.

We have also found that the addition of magnesium ions to a solution containing sodium lauryl sulfate or magnesium lauryl sulfate, and lauryl alcohol, provides two additional benefits. The first additional benefit pertains to a concentrate consisting of sodium lauryl sulfate and/or magnesium lauryl sulfate and lauryl alcohol to be added to water and PAA to form an in-use solution. A concentrate consisting of 15% sodium lauryl sulfate and/or magnesium lauryl sulfate and 3% lauryl alcohol is a solid at room temperature (~22° C.). Since the concentrate needs to be in liquid form to be easily dispensed and mixed with water and PAA, it must be warmed above room temperature; this introduces an inconvenience for the end user. However, a concentrate consisting of 15% sodium lauryl sulfate and/or magnesium lauryl sulfate, 3% lauryl alcohol, and 7.5% magnesium sulfate is a liquid at room temperature (~22° C.). This makes the concentrate containing magnesium sulfate more convenient to use.

The additional second benefit is that the in-use solution will produce a foam for a longer period of time when magnesium ions are present. An in-use solution prepared with sodium lauryl sulfate and/or magnesium lauryl sulfate, and lauryl alcohol (0.25% sodium lauryl sulfate, 0.05% lauryl alcohol), in 250 ppm hard water at room temperature (~22° C.), initially produced a foam. However, after 3 hours of sitting, the solution no longer produced a foam. On the other hand, when magnesium sulfate is present (0.25% sodium lauryl sulfate, 0.05% lauryl alcohol, 0.125% magnesium sulfate), prepared in 300 ppm hard water at room temperature (~22° C.), a foam is also initially produced. However, after 21 hours of sitting at ~22° C., the solution still produced a foam. Consequently, the in-use solution containing magnesium ions does not have to be applied within a short period of time after preparation, giving the end user added convenience since a new in-use solution would have to be prepared when its foam producing ability was lost. Furthermore, there is less wasting of material since unused solution would have to be discarded if it no longer produced foam.

Biopolymer Thickening Agents

Sanitizer composition (B) of the invention is an aqueous mixture containing about 10 ppm to about 3000 ppm of an antimicrobial agent, such as described above, and a retention aid comprising (i) at least one surfactant effective to reduce the surface tension of the sanitizer composition and, preferably, to induce foaming as well, (ii) a biopolymer or a mixture of biopolymers to thicken the composition and to enhance the stability, and, optionally, (iii) a water-soluble magnesium ion source (such as described above) to reduce the sensitivity of a foaming solution to hard water, particularly if the foam-inducing surfactant comprises sodium lauryl sulfate and/or magnesium lauryl sulfate, alone or in admixture with non-ionic surfactants.

The biopolymer thickeners are natural materials or derivatives thereof. Useful biopolymers in retention aids of sanitizer composition (B) include polysaccharides selected from galactomannans, such as guar and locust bean gum; glucomannans such as konjac; galactans such as agar and agarose; carrageenans such as kappa, iota and lambda carageenan; polyuronic acids such as algin; alginates; pectins; glucans such as dextrans, pullulan, and beta 1,3-glucans; chitin; xanthan: and tamarind; and heteropolysaccharides such as gellan, cassia, welan, gum arabic, karaya gum, okra gum, aloe gum, gum tragacanth, gum ghatti quinceseed gum, and other natural gums: psyllium; starch; arabinogalactan, and the like, including salts to the extent they do not unduly gel on the surface to be sanitized. Mixtures of any of the foregoing are also useful, such as xanthan/locus bean gum, agar/locusut bean gum, cassia/agar, cassia/xanthan, konjac/xanthan, carrageenan/locus bean gum, konjac/carrageenan, and konjac/starch.

Galactomannans (also called polygalactomannans) are polysaccharides composed principally of galactose and mannose units. They are usually found in the endosperm of leguminous seeds, such as guar (*Cyamopsis tetragonolobus*), locust bean, honey locust, flame tree, and the like. Guar flour is composed mostly of a galactomannan that is essentially a straight chain mannan with single-membered galactose branches. The mannose units are linked in a 1,4-β-glycosidic linkage. Galatose branching takes place by means of a 1–6 linkage on alternate mannose units. The ratio of galactose to mannose units is about one to two. Locust bean gum is a galactomannan of similar molecular structure in which the ratio of galactose to mannose is one to four.

Guar is a preferred biopolymer thickener for use in the retention aids of sanitizer composition (B) of the invention. Guar, konjac, and locust bean gum do not form gels by themselves and have viscosities that are independent of ionic strength. The viscosity of a solution remains substantially the same regardless of the water source, the presence of ionic surfactants, and the addition of the components of the sanitizer. This makes it easier to prepare sanitizer compositions of a desired viscosity. In contrast, the viscosities of xanthan gum solutions depend upon ionic strength. However, guar, unlike many other biopolymers, does not form gels with other biopolymers. Mixtures of guar and xanthan may also be used because guar shows a synergistic viscosity increase with xanthan gum, but a gel is not formed. A mixture of xanthan and glucomannan, preferably konjac, in the ratio of xanthan to glucomannan of about 9:1 to about 1:1, preferably about 5:1 to about 2:1, more preferably about 4:1 to 3:1 and most preferably about 3.5:1 to about 3:1 may also be used.

When a biopolymer or mixture of biopolymers is present, low levels of gum cross-linking agents may be present in the sanitizer to increase its viscosity and reduce the amount of thickening agent required to attain the desired viscosity, provided that the crosslinking agent does not prevent the sanitizer from spreading on the surface or substantially reduce the efficacy of the sanitizer. For example, the cross-linking agent should not substantially impede the spread of the peracid from the foam to the surface to which the sanitizer composition is applied. Gum cross-linking agents are disclosed, for example, in Richards, U.S. Pat. No. 5,597,791. Gum cross-linking agents include, for example, boric acid, borate salts, urea, and compounds that comprise polyfunctional cations and/or polyfunctional anions such as magnesium sulfate, and sodium sulfate. Particularly desirable are cross-linking agents that do not catalyze the decomposition of peroxygens such as borates and other chaotrophic agents, including urea, biuret and the like. Because of the combination of ionic and cross-linking effects, a cross-linking agent, especially an ionic cross-linking agent, may either increase or decrease the viscosity of the composition, depending on the nature of cross-linking agent selected and the concentration used.

Low levels of boric acid or other borates, for example, may be added. Typically, when a borate is used in the sanitizer composition, boric acid is used, but other borates such as sodium borate may be used. Up to, about 1 wt % of a borate, typically about 0.1 wt % to about 1 wt %, preferably about 0.3 wt % to about 0.8 wt %, may be used. When the use concentration of the borate is more than about 1 wt %, the viscosity of the composition may be adversely affected.

Sanitizer composition (B), in addition to water and antimicrobial agent, comprises about 0.025 wt % to about 1.0 wt % of the biopolymer thickener, such as are described above, and about 0.01 wt % to about 3 wt % of a surfactant or mixture of surfactants, and the finished santitizer composition will have a viscosity of about 3 to about 15,000 cP, preferably 5 cP to 500 cP. Preferred amounts of biopolymer thickener are about 0.1 wt % to about 0.5 wt %, and more preferably about 0.2 wt % to about 0.3 wt %, typically about 0.25 wt % of the sanitizer composition.

In sanitizer composition (B), the surfactant component is selected to reduce the surface tension of the sanitizer composition. Although the biopolymer or mixture of biopolymers may increase the viscosity of the sanitizer composition, the sanitizer composition will not spread evenly over the surface to which it is applied unless the critical surface tension of the sanitizer composition is less than the surface tension of the surface to which it is applied. (see, W. A. Zisman, "Relation of the Equilibrium Contact Angle to Liquid and Solid Constitution," in *Contact Angle Wettability and Adhesion*, Advances in Chemistry Series 43, R. F. Gould, ed, American Chemical Society, Washington D.C., 1984, p. 12). However, the biopolymer or mixture of biopolymers should increase the viscosity of the sanitizer composition without forming a gel. Gelled systems may be undesirable because gels are sufficiently elastic to prevent them from having high surface contact. In addition, the diffusion of peracetic acid antimicrobial agent, or other antimicrobial agent, from the gel to the surface may be retarded, thereby reducing the antimicrobial effect. Thus, the biopolymer or mixture of biopolymers and surfactant or surfactants should reduce the surface tension of the sanitizer composition below the critical surface tension of the surface to which the sanitizer will be applied, increase the viscosity of the sanitizer composition without producing a gel, and produce a stable foam.

As described above, the concentration of the surfactant or mixture of surfactants in sanitizer composition (B) should be high enough that the surface tension of the sanitizer composition is reduced to the point at which the sanitizer spreads over the surface to which it has been applied. For use of the sanitizer composition on stainless steel surfaces, the surface tension of the sanitizer composition should be reduced to about 35 dynes/cm or less. The retention aids of the invention described above can reduce the surface tension of the sanitizer composition to about 25 dynes/cm or less.

The surfactant component for use with the biopolymer thickeners may comprise any surfactant or mixture of surfactants satisfying such surface tension requirements and provided the surfactants do not unduly gel or otherwise interfere with sanitizing effect. Accordingly, a single surfactant, including ionics (anionic, cationic, amphoteric) and non-ionics, may be used, or a mixed surfactant may be used, such as the surfactant mixture comprising the retention aid of sanitizer composition (A) described above. Anionic surfactants, alone or in admixture with non-ionic surfactants, are preferred. Anionic surfactants include primary and secondary alkane sulfonates, primary alkyl sulphates, and alkylaryl sulphonates. Non-ionic surfactants include long chain alcohols such as lauryl alcohol, undecyl alcohol, cetyl alcohol, and the like; alkylphenol ethoxylates ethylene oxide-propylene oxide polymers; fatty alcohol polyglycol ethers; and alkoxylated alcohols. Cationic surfactants include known alkyl amine oxides and quaternary ammonium compounds such as dialkyl dimethyl ammonium chloride wherein the alkyl groups contain 8 to 12 carbon atoms, such as described in EP 733097. Amphoteric surfactants include the alkyl betaines and sulfonated alkyl betaines.

Typically, the surfactant or surfactants comprises about 0.01 wt % to about 3.0 wt %, more typically 0.1 wt % to about 0.5 wt %, of the sanitizer composition (B).

The use concentration of the biopolymer thickener in sanitizer composition (B) will depend on the viscosity desired, the concentration of the peracid or other antimicrobial agent, and the nature and concentration of other materials present in the sanitizer, if any. For example, when 0.05%–0.1% (w/w) of the biopolymer thickening agent is present in sanitizer compositions comprising 10 parts per million (ppm) to 100 ppm peracetic acid or other antimicrobial agent, viscosities in the range of 3 to 1300 cP are readily achieved. A preferred viscosity of sanitizer composition (B) are is about 3 to about 1500 cP, more preferably about 5 cP to about 100 cP.

Other Additives

Other antimicrobial agents may used in admixture with those described above for sanitizer compositions (A) and (B), and with other components. These include gluteraldehyde and quaternary ammonium compounds. For example, a biocidal quaternary ammonium compound in admixture with an alcohol having a hydrocarbon region of similar size to the quaternary ammonium compound could be used.

Other additives include colorants for visual detection of the antimicrobial agent on a surface; synthetic thickeners such as polyacrylates, polyacrylamidesand cellulose derivatives such as various hydroxy alkyl celluloses (carboxy methyl cellulose and the like); coupling agents such as short chain alcohols; hydrotropes; pH control agents such as acetic acid or ammonium hydroxide; and the like.

Sanitizer Composition Preparation

The sanitizer composition may be prepared by mixing an aqueous organic peracid or other antimicrobial agent solution, such as a solution comprising about 5% to about 35% by weight peracetic acid, and an aqueous solution of the retention aid. If the antimicrobial agent is an organic peracid, such as peracetic acid, the concentration of hydrogen peroxide and organic acid in the sanitizer composition will depend on the concentration in the starting peracid solution and the dilution necessary to produce the sanitizer with the desired peracid concentration because, as described above, organic peracids are formed in equilibrium processes and the equilibrium reaction causes the concentration of peracid to slowly change after the concentrated peracid solution has been diluted, the sanitizer composition is preferably used soon after its preparation. Typically, the required volume of peracid solution is mixed with a much larger volume of the stabilizer system. This can be done in either a continuous process in which the solutions are mixed and, for example, sprayed immediately after mixing, or in a batch process. Refrigeration may decrease the rate of the equilibrium processes and decrease the rate of concentration change in the sanitizer.

If the sanitizer compositions are to be stored before use, the surfactants and other ingredients used in the sanitizer compositions should be compatible with the peracid and with hydrogen peroxide. That is, the surfactants and other ingredients used in the sanitizer compositions should be stable to the peracid and to hydrogen peroxide, and the surfactants and other ingredients used should not decrease or cause loss of the peracid. For this reason, ethoxylates and surfactants with unsaturated hydrocarbon chains may be less useful than other surfactants in the sanitizer compositions of the invention.

With the exception of the peracid or other antimicrobial solution, all of the components of the sanitizer compositions of the invention can be stored and shipped either as dry powders or tablets, or as aqueous concentrates, either as individual components or as mixtures of components in predetermined ratios. The components are dissolved or mixed and, if necessary, diluted, prior to use to form the sanitizer compositions. Preparation of the sanitizer composition may be carried out at the point of use, if desired.

Sanitizer Composition Kits and Concentrates

In another aspect, the invention includes a kit comprising two or more parts. A first part comprises a peracid or other antimicrobial agent solution, typically an aqueous peracid solution that is at or near equilibrium. Typically the solution comprises about 5% to about 35% by weight of a peracid, such as peracetic acid, or mixture of peracids, such as a mixture of peracetic acid and peroctanoic acid, or other antimicrobial agent. A second part may comprise the retention aid. The retention aid can be supplied as a solid or an aqueous solution, preferably as an aqueous concentrate. In use, the first and second parts are mixed together and, if necessary, diluted to produce the sanitizer composition. For a concentrate that contains sodium lauryl sulfate and lauryl alcohol, the sodium lauryl sulfate and lauryl alcohol may be present, for example, in the ratio by weight of about 5:1, i.e., about 20 wt % sodium lauryl sulfate and about 4 wt % lauryl alcohol; about 10 wt % sodium lauryl sulfate and about 2 wt % lauryl alcohol; and similar concentrations for other surfactants, or surfactant and biopolymer thickener. For a concentrate that contains sodium lauryl sulfate, lauryl alcohol, and magnesium sulfate, the sodium lauryl sulfate, lauryl alcohol, and magnesium sulfate may be present, for example, in the ratio by weight of about 10:2:5, i.e., about 20 wt % sodium lauryl sulfate, about 4 wt % lauryl alcohol, and about 10 wt % magnesium sulfate; about 10 wt % sodium lauryl sulfate, about 2 wt % lauryl alcohol, and about 5 wt % magnesium sulfate. More preferably, the ratio by weight percentage is 15% sodium lauryl sulfate, 3% lauryl alcohol, and 7.5% magnesium sulfate. Most preferably, the ratio by weight percentage is 15.5% sodium lauryl sulfate, 2.8% lauryl alcohol and 7.5% magnesium sulfate.

The kit may also comprise three parts. With respect to santizer composition (A), the first part comprises the peracid or other antimicrobial agent solution; the second part comprises the non-ionic surfactant; and the third part comprises the anionic surfactant. The surfactants can be supplied either as solids or as aqueous solutions, preferably as aqueous concentrates. In use, the parts are mixed together and, if necessary, diluted to produce the sanitizer composition. When the sanitizer composition is supplied in three parts, the ratio of surfactants in the mixture of surfactants can be adjusted, if necessary, during preparation of the retention aid.

With respect to sanitizer composition (B), the sanitizer composition can be supplied in two, three or four parts. The first part comprises the peracid or other antimicrobial agent solution and the second part comprises the retention aid including the biopolymer or mixture of biopolymers. Alternatively, the first part comprises the peracid or other antimicrobial agent solution; the second part comprises the surfactant portion of the retention aid; and the third part comprises the biopolymer or mixture of biopolymers. Alternatively, the first part comprises the peracid or other antimicrobial agent solution; the second part comprises a non-ionic-surfactant; the third part comprises an ionic surfactant, and a fourth part comprises the biopolymer or mixture of biopolymers. When only one surfactant is used with a mixture of biopolymers, the sanitizer composition can be supplied in three parts in which the first part comprises the peracid or other antimicrobial agent solution, the second part comprises the surfactant, and the third part comprises the biopolymer or mixture of biopolymers. Alternatively, when a mixture of biopolymers is used, the sanitizer can be supplied in four parts in which the first part comprises the peracid or other antimicrobial agent solution, the second part comprises the surfactant, and the third part comprises the first biopolymer, and the fourth part comprises the second biopolymer.

The retention aid including the surfactants can be supplied either as solids or as aqueous solutions, as described above. The biopolymer can be supplied either as a solid or as an aqueous solution, preferably as an aqueous concentrate. In use, the parts are mixed together and, if necessary, diluted to produce the sanitizer composition. For convenience, it may be useful to have a mixture of biopolymers supplied as a single component.

Use of the Sanitizer Compositions

Because the sanitizer compositions have low surface tension, they will spread on and "wrap-around" irregular surfaces, such as gratings, chains, bents, coils, etc., especially on and into areas that are not directly accessible to, or hidden from, the liquid or foam stream that is being applied to the surface. The sanitizer composition is easier to apply than high viscosity systems because it is more readily pumped and sprayed than high viscosity systems. The sanitizer composition, especially when applied as a foam, is retained on the surface for a longer period of time so that less material is required for a given biocidal effect, producing a lower cost-in-use. Because the sanitizer composition spreads on the surface and is retained on the surface for a longer period of time, it is less likely that areas of the surface will be missed due to operator error. When a surfactant pair, especially sodium lauryl sulfate and lauryl alcohol, is present, the odor of antimicrobial agent such as peracid (e.g., peracetic acid) is less noticeable.

The sanitizer composition is especially suited for sanitizing surfaces on which water does not spread, such as stainless steel, plastics, and foods such as animal carcasses and produce, and is well suited for both domestic and industrial applications, such as in the food service, food processing, and health care industries, especially on food and food-contact surfaces. Although the sanitizer composition is especially used on food and food-contact surfaces it can also be used on non-food contact surfaces. It can be applied by any method that insures good contact between the surface to be sanitized and the sanitizer, for example, by coating, dipping, spraying, fogging, etc. It can be used to sanitize a wide variety of surfaces, for example, to sanitize animal carcasses, fruits and vegetables, medical instruments, and hard surfaces, such as floors, counters, furniture, etc., such as are found in, for example, the health care industry. Furthermore, the invention is useful as foaming foot baths, for example, in the eradication of Foot and Mouth Disease, and for decontamination as described in EP 1166825, published Jan. 2, 2002.

Although the invention has been exemplified on solid surfaces, such as stainless steel coupons and food processing equipment, a "surface," as used in this specification and claims, may be continuous or discontinuous, solid or porous, soft or hard, synthetic or natural, fibrous or non-fibrous, metallic or non-metallic, or have any other form, shape or character in or on which antimicrobial action is desired. Accordingly, the term "surface" includes but is not limited to, foods of all kinds, woven materials such as cloth, paper, wood, netting, screens, sponges, ceramics, particulates, metals, plastics, packaging, and combinations and composites of these or other materials, and any other material or environment in which high retention of an antimicrobial is desired.

The sanitizer composition can be used to sanitize a wide variety of animal carcasses such as: muscle meats such as beef, pork, veal, buffalo, lamb, venison, and mutton; seafood, such as scallops, shrimp, crab, octopus, mussels, squid, lobster, and fish such as salmon, mackerel, flounder, bass, catfish, and trout; and poultry such as chicken, turkey, ostrich, game hen, duck, squab, and pheasant. "Animal carcass" refers to a portion of a carcass, for example an individual cut of meat, seafood, or poultry, as well as the entire carcass. It can also be used to sanitize a wide variety of fruits and vegetables, for example produce products such as asparagus, head lettuce, leaf lettuce, Romaine lettuce, endive, parsley, spinach, radishes, celery, carrots, beets, onions, rhubarb, eggplant, peppers, cucumbers, tomatoes, potatoes, sweet potatoes, turnips, rutabagas, zucchini, cabbage, kale, kohlrabi, collard greens, cauliflower, Brussels sprouts, okra, mushrooms, and dandelion greens; fruits such as apples, peaches, cherries, apricots; quince, plums, grapes, and pears; and berries such as strawberries, raspberries, gooseberries, loganberries, boysenberries, cranberries, currants, elderberries, blackberries, and blueberries.

Various techniques are known for applying the sanitizer composition to animal carcasses. These techniques are generally disclosed in Gutzmann, U.S. Pat. No. 6,010,729, especially column 13, line 39, to column 16, line 20. These include, for example, spraying by a manual wand, spraying using multiple spray heads preferably in a spray booth, electrostatic spraying, fogging, and dipping or immersion preferably into an agitated solution.

The sanitizer compositions of the invention have longer retention times when applied to vertical and other non-horizontal surfaces, and thus are particularly suited for use as a sanitizer for food processing equipment. The sanitizer composition is sprayed or wiped onto a food-processing surface and permitted to remain on the surface for a time sufficient to sanitize the surface. Because of the stability of foams produced by the sanitizer compositions of the invention, in one preferred aspect of the invention, the sanitizer composition is applied as a foam. Foams can prepared and applied using standard commercial equipment, such as, for example, the FOAM-IT® applicator, manufactured by Innovative Cleaning Equipment, Inc., Grand Rapids Mich., USA.

The advantageous properties of this invention will be further appreciated by reference to the following examples, which illustrate but do not limit the invention.

EXAMPLES

GLOSSARY

| | |
|---|---|
| DDBSNa | Dodecylbenzenesulfoninc acid, sodium salt |
| LA | Lauryl alcohol (1-dodecanol) (technical grade - 98%) |
| MLS | Magnesium lauryl sulfate (STEPANOL ® MG, Stepan, Northfield, IL, USA) |
| PAA | Peracetic acid |
| SLS | Sodium lauryl sulfate (97% sodium lauryl sulfate) (STEPANOL ® WA-100, Stepan, Northfield, IL, USA) |
| TWEEN ® 20 | Polysorbate 20, laurate esters of sorbitol reacted with about 20 moles of ethylene oxide (ICI) |
| TWEEN ® 80 | Polysorbate 80, oleate esters of sorbitol reacted with about 20 moles of ethylene oxide (ICI) |
| Positive Control | The amount of bacteria present in the initial population, prior to being treated with the test sanitizer composition, expressed as Log10. |
| Log10 Reduction | The amount of bacteria reduced from the initial population ("Positive Control") after being treated with the test sanitizer composition, expressed in Log10. |

Preparation of the Sanitizer Compositions

The 5% PAA solution used to prepare the sanitizer compositions had the following composition, by weight: 5% PAA, 22% hydrogen peroxide; 10% acetic acid, and 63% water. A 20% SLS and 4% LA concentrate was prepared by adding 200 g of SLS, 40 g of LA, and 760 g of dionized water to a beaker. The resulting mixture was stirred with gentle heating (about 50° C.) until a clear slightly yellow solution formed. A 20% SLS and 2.5% LA concentrate was prepared in a similar manner.

The sanitizer compositions used in the Examples were prepared as follows:

85 ppm PAA. 5% PAA was diluted to 85 ppm with deionized water.

100 ppm PAA. 5% PAA was diluted to 100 ppm with deionized water.

85 ppm PAA+0.25% guar. Guar gum was added to deionized water to give a 0.25% (w/w) mixture. The mixture was mixed at high-shear to dissolve the guar gum. 5% PAA was added to this solution to give a final PAA concentration of 85 ppm.

85 ppm PAA+0.25% guar and 0.5% TWEEN® 80. TWEEN® 80 was added to a 0.25% guar gum solution to give a final concentration of 0.5% (w/w). 5% PAA was added to this solution to give a final PAA concentration of 85 ppm.

85 ppm PAA+0.5% TWEEN® 80. TWEEN® 80 was added to deionized water to give a final concentration of 0.5% (w/w). 5% PAA was added to this solution to give a final PAA concentration of 85 ppm.

85 ppm PAA+0.5% TWEEN® 20. TWEEN® 20 was added to deionized water to give a final concentration of 0.5% (w/w). 5% PAA was added to this solution to give a final PAA concentration of 85 ppm.

100 ppm PAA+0.5% TWEEN® 20. TWEEN® 20 was added to deionized water to give a final concentration of 0.5% (w/w). 5% PAA was added to this solution to give a final PAA concentration of 100 ppm.

85 ppm PAA+0.5% SLS—SLS was added to deionized water to give a final concentration of 0.5% (w/w). 5% PAA was added to this solution to give a final PAA concentration of 85 ppm.

100 ppm PAA+0.5% SLS—SLS was added to deionized water to give a final concentration of 0.5% (w/w). 5% PAA was added to this solution to give a final PAA concentration of 100 ppm.

85 ppm PAA+0.25% SLS—SLS was added to deionized water to give a final concentration of 0.25% (w/w). 5% PAA was added to this solution to give a final PAA concentration of 85 ppm.

100 ppm PAA+0.25% SLS—SLS was added to deionized water to give a final concentration of 0.25% (w/w). 5% PAA was added to this solution to give a final PAA concentration of 100 ppm.

100 ppm PAA+0.5% DDBSNa—DDBSNa was added to deionized water to give a final concentration of 0.5% (w/w). 5% PAA was added to this solution to give a final PAA concentration of 100 ppm.

85 ppm PAA+0.25% SLS and 0.013% LA—SLS and LA were added to deionized water to give final concentrations of 0.25% (w/w) and 0.013% respectively. PAA was added to this solution to give a final PAA concentration of 85 ppm.

85 ppm PAA+0.25% SLS and 0.05% LA—SLS and LA were added to deionized water to give final concentrations of 0.25% (w/w) and 0.05% (w/w) respectively. PAA was added to this solution to give a final PAA concentration of 85 ppm.

85 ppm PAA+0.25% SLS+0.05% LA—20% SLS/4% LA concentrate was diluted to SLS/LA of 0.25%/0.05% (w/w) with tap water. 5% PAA was added to give a final PAA concentration of 85 ppm.

85 ppm PAA+0.25% SLS+0.03%LA—20% SLS/2.5% LA concentrate was diluted to SLS/LA of 0.25%/0.03% (w/w) with tap water. 5% PAA was added to give a final PAA concentration of 85 ppm.

85 ppm PAA+0.25% SLS—SLS was added to tap water to give a final concentration of 0.25% (w/w). 5% PAA was added to give a final PAA concentration of 85 ppm.

Example 1

In this Example, sanitizer compositions were tested against *E. coli* 0157:H7 to determine the bactericidal effects of each test formula against gram negative organisms.

Pathogen Preparation

In a sterile specimen cup, 90 mL of sterile Caso broth (DIFCO), with 10% organic load consisting of either 5 mL of Fetal Bovine Serum (SIGMA) and 5 mL of Egg Yolk Enrichment, 50% (DIFCO) or 10 mL of Fetal Bovine Serum were added and warmed at 37° C. The selection of either organic load is completely arbitrary and does not influence the experimental outcome. 11 mL of an *E. coli* 0157:H7 (ATCC 35150) peptone suspension was then added and the entire solution incubated at 37° C. for 2 hr for a $10^7$ suspension.

After 2 hr, the pathogen preparation solution was moved to room temperature. Stainless steel coupons (Grade 304, 3.5 in.×2.75 in.) were inoculated by adding 0.20 g of the pathogen preparation to each coupon and then spreading the inoculum over the face of the coupon with a sterile hockey stick. The coupons were individually placed on sterile petri dishes and incubated at 30° C. for about 1 hr to make a surface dried bacterial film. After 1 hr, the coupons were moved to room temperature.

Product Application

Each coupon was attached to a "T-bar" in a Labconco Biosafety Cabinet with a VELCRO® fastener. With a minimum of two replicates per sanitizer composition being tested, each coupon was treated for 10 sec with the appropriate sanitizer composition at a flow rate of 30 mL/min from a distance of 20 cm using a thin layer chromatographic sprayer. Each sanitizer composition was applied as a liquid. Each coupon after being sprayed was permitted a 60 sec contact period.

Neutralization, Plating and Incubation

After 1 min, each coupon was swabbed with a WHIRL-PAK® sponge rehydrated with 100 mL Letheen broth with 0.5% sodium thiosulfate. The sponge bags were stomached in a STOMACHER® 400 circulator at 230 rpm for 30 sec and then serially diluted in Butterfield's phosphate buffer with $10^{-2}$ and $10^{-4}$ dilutions plated onto LMG agar using ISO-GRID® methodology. The plates were incubated at 37° C. for 24 hr and then enumerated. The results are shown in Table 1. It is evident that a significantly greater rate of kill (>99%) was achieved by incorporating a biopolymer alone and/or with one or more surfactants, than with the peracetic acid product with no additives included. In each case, the additives provided lower surface tension and/or better adhesion of the composition to provide for better efficacy on the vertical surface.

TABLE 1

| Sanitizer Composition | Average $Log_{10}$ Reduction | Positive Control |
|---|---|---|
| 85 ppm PAA | 2.59 | 6.20 |
| 85 ppm PAA + 0.25% Guar | 5.80 | 6.32 |
| 85 ppm PAA + 0.25% Guar + 0.5% TWEEN ® 80 | 5.30 | 6.20 |
| 85 ppm PAA + 0.5% TWEEN ® 80 | 4.58 | 6.20 |
| 85 ppm PAA + 0.5% TWEEN ® 20 | 4.73 | 6.97 |
| 85 ppm PAA + 0.5% SLS | 4.50 | 7.34 |
| 85 ppm PAA + 0.25% SLS | 4.45 | 7.34 |
| 85 ppm PAA + 0.25% SLS + 0.013% LA | 5.04 | 7.34 |
| 85 ppm PAA + 0.25% SLS + 0.05% LA | 5.59 | 7.34 |

Example 2

The procedure of Example 1 was repeated except that the sanitizer composition solutions were tested against *Listeria monocytogenes* to determine their effectiveness against gram positive organisms.

Pathogen Preparation

In a sterile specimen cup, 90 mL of sterile Caso broth (DIFCO) with 0.6% Yeast Extract (SIGMA) and a 10% organic load consisting of either 5 mL of Fetal Bovine Serum (SIGMA) and 5 mL of Egg Yolk Enrichment, 50% (DIFCO) or 10 mL of Fetal Bovine Serum were added and warmed at 37° C. The selection of either organic load is completely arbitrary and does not influence the experimental outcome. 11 mL of a *Listeria monocytogenes* (ATCC 43256) peptone suspension was then added and the entire solution incubated at 37° C. for 2 hr for a $10^7$ suspension.

Stainless steel coupons (Grade 304, 3.5 in.×2.75 in.) were prepared and inoculated as described in Example 1.

Product Application

Each coupon was attached vertically to a "T-bar" in a Labconco Biosafety Cabinet with a VELCRO® fastener. With a minimum of two replicates per sanitizer composition being tested, each coupon was treated for 10 sec. with the appropriate sanitizer composition at a flow rate of 30 mL/min. from a distance of 20 cm using a thin layer chromatographic sprayer. Each sanitizer composition was applied as a liquid. Each coupon after being sprayed was permitted a 60 sec. contact period.

Neutralization, Plating and Incubation

After 1 min, each coupon was swabbed with a WHIRL-PAK® sponge rehydrated with 100 mL Letheen broth with 0.5% sodium thiosulfate. The sponge bags were stomached in a STOMACHER® 400 circulator at 230 rpm for 30 sec and then serially diluted in Butterfield's phosphate buffer with $10^{-2}$ and $10^{-4}$ dilutions plated onto tryptic soy agar (with 0.6% Yeast Extract and TTC dye) using ISO-GRID® methodology. The plates were incubated at 30° C. for 48 hr and then enumerated. Results are shown in Table 2. The results demonstrate a significantly greater kill rate (at least greater than >90%) when a biopolymer alone and/or with surfactants is incorporated with the PAA versus PAA alone, when treating vertical surfaces. Again, the presence of the additives provides either lower surface tension for better spreading and/or higher retention of the sanitizer composition, thereby providing for more effective contact of the sanitizer with the contaminated surface.

TABLE 2

| Sanitizer Composition | Average $Log_{10}$ Reduction | Positive Control |
|---|---|---|
| 85 ppm PAA | 2.76 | 7.09 |
| 100 ppm PAA | 3.31 | 6.05 |
| 85 ppm PAA + 0.25% Guar | 5.56 | 7.10 |
| 100 ppm PAA + 0.5% TWEEN ® 20 | 3.95 | 6.05 |
| 100 ppm PAA + 0.5% SLS | 3.80 | 6.05 |
| 100 ppm PAA + 0.25% SLS | 4.12 | 7.47 |
| 100 ppm PAA + 0.5% DDBSNa | 3.79 | 6.05 |
| 85 ppm PAA + 0.25% SLS + 0.013% LA | 4.20 | 7.47 |
| 85 ppm PAA + 0.25% SLS + 0.05% LA | 4.02 | 7.47 |

Example 3

Sanitizer compositions were tested under field trial conditions using a FOAM-IT® 5-gallon unit (Innovative Cleaning Equipment, Inc., Grand Rapids Mich., USA) versus *Lactobacillus casei*, subsp. *casei* (ATCC 393). The FOAM-IT® unit is used to apply foams to surfaces. It has a bucket and an attachment that adjusts the air/water mix. The unit is attached to an air compressor to generate a positive pressure to dispense the foam.

The 85 ppm PAA and the 85 ppm PAA+0.25% guar sanitizer compositions were applied as liquids, because neither sanitizer composition contained a surfactant to induce foaming. The 85 ppm PAA+0.5% TWEEN® 20 and the 85 ppm PAA+0.25% guar and 0.5% TWEEN® 20 sanitizers were applied as foams.

Bacterial Suspension and Coupon Preparation

In a sterile specimen cup, 90 mL of sterile Lactobacilllus MRS broth (DIFCO) with 5 mL of Fetal Bovine Serum (SIGMA) and 5 mL of Egg Yolk Enrichment, 50% (DIFCO) and 11 mL of a *Lactobacillus casei*, subsp. *casei* (ATCC 393) peptone suspension were added and the entire solution incubated at room temperature for 16 hr for a $10^7$ suspension.

At 16 hr, 20 g of the suspension was stirred well to evenly distribute the bacteria. Stainless steel coupons (Grade 304, 3.5 in.×2.75 in.) were inoculated by adding 0.20 g of the bacterial suspension to each coupon, and then by spreading the inoculum over the face of the coupon with a sterile hockey stick. The coupons were individually placed on sterile petri dishes and incubated at room temperature for about 1 hr to make a surface dried bacterial film.

Product Application

Coupons were attached to the coil, ceiling, wall, and shelf regions of a Frigoscandia Gyrocompact unit with VELCRO® fasteners. Three coupons were attached to each of the four regions. Using a FOAM-IT® 5-gallon unit, each system was applied for a period of 5 min to the entire area of the interior of the unit in order to simulate a sanitization procedure without giving special focus to the individual coupons. After an additional 15 min contact time, the coupons were removed.

Neutralization, Plating and Incubation

The coupons were swabbed with SpongeSicles™ rehydrated with 10 mL of neutralizing buffer. 50 mL of Lactobacilllus MRS Broth with 0.5% sodium thiosulfate was added to each bag. The sponge bags were stomached in a STOMACHER® 400 circulator at 230 rpm for 30 sec and then serially diluted in Butterfield's phosphate buffer, with $10^{-2}$ and $10^{-4}$ dilutions plated onto Lactobacilllus MRS agar with 0.025% Fast Green FCF using ISO-GRID® methodology. The plates were incubated at 30° C. in a microaerophilic environment for 72 hr and then enumerated. The results are shown in Table 3. The data clearly indicates that a significantly superior reduction (at least >90%) can be achieved by adding both the surfactant and the biopolymer when applied to particular surfaces, such as the wall and shelf regions, when compared to the PAA alone and PAA with only one surfactant or with only biopolymer. Later studies and results, described in Examples 4 et seq. below, indicate that longer retention time with high foam quality can be obtained with certain surfactant combinations.

TABLE 3

| Results showing Average $Log_{10}$ Reductions | | | | | |
|---|---|---|---|---|---|
| Sanitizer Composition | Coil Region | Ceiling Region | Wall Region | Shelf Region | Positive Control |
| 85 ppm PAA | 5.00 | 5.15 | 3.36 | 4.65 | 5.65 |
| 85 ppm PAA + 0.5% TWEEN ® 20 | 4.80 | 4.45 | 3.88 | 4.65 | 5.65 |
| 85 ppm PAA + 0.25% Guar | 3.64 | 5.00 | 4.58 | 4.41 | 5.65 |
| 85 ppm PAA + 0.25% Guar + 0.5% TWEEN ® 20 | 4.65 | 5.15 | 5.65 | 5.65 | 5.65 |

Example 4

Sanitizer compositions were tested against *Lactobacillus casei*, subsp. *casei* (ATCC 393) under simulated field trial conditions using a FOAM-IT® 5 gallon unit. The 85 ppm PAA was applied as a liquid. The other sanitizer compositions were applied as foams.

Bacterial Suspension Preparation

In a sterile specimen cup, 90 mL of sterile Lactobacilllus MRS broth (DIFCO), 5 mL of Fetal Bovine Serum (SIGMA) and 5 mL of Egg Yolk Enrichment, 50% (DIFCO) were added and warmed at 37° C. 11 mL of a *Lactobacillus casei*, subsp. *casei* (ATCC 393) peptone suspension was then added and the entire solution incubated at 37° C. for 16 hr for a $10^7$ suspension.

Coupon Preparation

After 16 hr, the suspension was moved to room temperature. Stainless steel coupons (Grade 304, 3.5 in.×2.75 in.) were inoculated by adding 0.15 g of the bacterial suspension preparation to each coupon and spreading the inoculum over the face of the coupon with a 10 $\mu$L inoculating loop. The coupons were individually placed on sterile petri dishes and incubated at 30° C. for 1 hr to make a surface dried bacterial film.

Product Application

Three coupons at a time were placed vertically on a stainless steel cabinet (34.5 in.×72 in.) with VELCRO® fasteners in the meat pilot plant (temperature of 8.8° C.). Using a FOAM-IT® 5-gallon unit, each system was applied for a period of 35 sec to the entire cabinet in order to simulate a sanitization procedure without giving special focus to the individual coupons. The water control solution, PAA control sanitizer composition, and 0.25% SLS sanitizer composition were allowed a contact period of 5 min. The 0.25% SLS/0.05% LA sanitizer composition had a contact period of 8.5 min. The 0.25% SLS/0.03% LA sanitizer composition had a contact period of 6.5 min. The latter two systems had a longer contact time because the time required for the sanitizer compositions to move off of the coupon was longer.

Neutralization, Plating and Incubation

The coupons were swabbed with WHIRL-PAK® sponges rehydrated with 100 mL Letheen broth with 0.5% sodium thiosulfate. The sponge bags were stomached in a STOMACHER® 400 circulator at 230 rpm for 30 sec and then serially diluted in Butterfield's phosphate buffer with $10^{-2}$ and $10^{-4}$ dilutions plated onto *Lactobacilllus* MRS agar with 0.025% Fast Green FCF using ISO-GRID® methodology. The plates were incubated at 30° C. in a microaerophilic environment for 72 hr and then enumerated. The results, shown in Table 4, indicate that all of the compositions, when applied for a long duration, are able to achieve an equivalent kill. It is also demonstrated that the reductions are not simply a matter of mechanical action, as shown by the virtual lack of reduction in the water control.

TABLE 4

| Sanitizer Composition | Avg. $Log_{10}$ Reduction with 35 sec application of Sanitizer Composition |
|---|---|
| Water Control | 0.26 |
| 85 ppm PAA | 6.34 |
| 85 ppm PAA + 0.25% SLS/0.05% LA Foam | 5.68 |
| 85 ppm PAA + 0.25% SLS/0.03% LA Foam | 6.34 |
| 85 ppm PAA + 0.25% LA Foam | 6.34 |
| Positive Control | 6.34 |

Example 5

The procedure of Example 4 was repeated in all essential respects except that the application time of the sanitizer compositions to the coupons was shorter, demonstrating the advantages of a high-retention system (a smaller amount of material being required for a given kill).

Three coupons at a time were placed vertically on a stainless steel cabinet (34.5 in.×72 in.) with VELCRO® fasteners in the meat pilot plant that has a room temperature of 8.8° C. Using a FOAM-IT®, each system was applied for a period of 2 sec per coupon with a 5-min contact period. The results, shown in Table 5, clearly indicate that the 0.25% SLS/0.05% LA provides far superior reductions in bacterial counts (almost 99.99%) than the 0.25% SLS/0.03% LA and the 0.25% SLS. This data demonstrates that significantly less product will be necessary with the present invention compared to PAA alone to achieve equivalent kill rates (see previous Examples), thus providing cost reductions in terms of chemical usage, water usage and employee time in application of the chemicals.

TABLE 5

| Sanitizer Composition | Avg. $Log_{10}$ Reduction with 2 sec application of Sanitizer Composition |
|---|---|
| 85 ppm PAA | 0.25 |
| 85 ppm PAA + 0.25% SLS/0.05% LA Foam | 5.67 |
| 85 ppm PAA + 0.25% SLS/0.03% LA Foam | 1.83 |
| 85 ppm PAA + 0.25% SLS Foam | 1.78 |
| Positive Control | 7.00 |

Example 6

Surface tension measurements were carried out with a ring tensiometer at about 22° C. The surface tension of an aqueous solution containing 0.25% SLS was 31.32 dynes/cm. The surface tension of an aqueous solution containing 0.25% SLS and 0.01% of LA was 21.00 dynes/cm. The surface tension of an aqueous solution containing 0.25% SLS and 0.05% of LA was 20.26 dynes/cm. This shows that significant reduction of surface tension is achieved by combining surfactants, with even greater reduction by increasing the non-ionic surfactant (LA) content, thus improving spreadability of the compositions on surfaces.

Example 7

Foams were sprayed onto a vertical stainless steel surface using a FOAM-IT® 5-gallon unit. Foam stability was observed visually. When the LA/SLS ratio was less than about 0.1 at an SLS concentration of about 0.2%, a stable long-lasting foam (in comparison to a 0.2% SLS solution without any added LA) was produced. However, the foam did not adhere well to the surface. It rapidly fell down and broke apart. When the LA/SLS ratio was greater than 0.1, the foams were much more homogenous. They had much longer retention times on the surface and did not break-up when they ran down the surface. A 0.25 wt % SLS solution with LA/SLS ratio of 0.2 had a longer retention time than a 0.25 wt % SLS solution with a LA/SLS ratio of 0.125.

Example 8

This Example illustrates the effect of calcium ion and of magnesium ion on foaming.

When a 0.25% SLS solution was prepared in water containing 333 ppm of calcium chloride (300 ppm in the more common units of calcium carbonate), the solution instantly became turbid. When a 0.25% MLS solution was prepared in water containing 333 ppm of calcium chloride, the solution did not become turbid for about 2 min.

Using a FOAM-IT® unit, the SLS/LA system does not produce a foam in water containing 300 ppm of hardness (expressed in terms of calcium carbonate) when all the hardness is due to calcium chloride (333 ppm calcium chloride). However, good foaming was obtained when the SLS/LS system was added to water containing 300 ppm of hardness (expressed in terms of calcium carbonate) when all the hardness is due to magnesium sulfate (361 ppm of magnesium sulfate).

When a 0.25% SLS solution was prepared in water containing 333 ppm of calcium chloride, the solution instantly became turbid. When a 0.25% MLS solution was prepared in water containing 333 ppm of calcium chloride, the solution became turbid after about 2 min. This demonstrates that magnesium ions are more difficult for the calcium ions to displace from the LS anion than sodium ions to form the insoluble and foam-decreasing $Ca(LS)_2$ species.

Hard water contains both magnesium and calcium ions. For a 300 ppm total hardness (expressed as calcium carbonate), there is about 200 ppm hardness as calcium and 100 ppm hardness as magnesium (AOAC Official Methods of Analysis, 1995, Chapter 6, p. 10). When a 0.25% solution of SLS was prepared in 300 ppm total hardness water containing calcium and magnesium ions in this ratio, the solution immediately became turbid. When 0.25% solution of MLS was prepared in 300 ppm total hardness water containing calcium and magnesium ions in this ratio, the solution became turbid after about 5 minutes.

By comparing this result with the result obtained for MLS in hard water containing only calcium ions, it is demonstrated that excess magnesium ions (naturally present as a component of water hardness) provide extra protection of the soluble, foam-producing, $Mg(LS)_2$ species from substitution by calcium ions that form the water-insoluble, foam-reducing $Ca(LS)_2$ species. Furthermore, this suggests that even further protection of the foam producing ability of the $Mg(LS)_2$ species can be accomplished by the addition of excess magnesium ions.

Example 9

This Example illustrates the use of added magnesium ion to produce foaming in hard water.

A sanitizer composition containing 0.25% SLS, 0.05% LA, and 85 ppm PAA was prepared in the 300 ppm total hardness water described in Example 8. This solution was applied to a stainless steel cabinet (34.5 in.×72 in.) in the meat pilot plant with a FOAM-IT® 5 unit using the driest foam setting. No foam was produced; only a white liquid appearing like milk resulted.

A sanitizer composition containing 0.25% SLS, 0.05% LA, 0.125% magnesium sulfate, and 85 ppm PAA was prepared in the 300 ppm total hardness water described in Example 8. This solution was applied to a stainless steel cabinet (34.5 in.×72 in.) in the meat pilot plant with a FOAM-IT® 5 unit using the driest foam setting. A foam similar in consistency and retention to that produced by a sanitizer containing 0.25% SLS, 0.05% LA, and 85 ppm PAA prepared in tap water (~110 ppm total hardness), resulted. The PAA concentration remained stable at 85 ppm for at least 30 hours.

Example 10

This Example illustrates the effect of chelating agent on sanitizer compositions. The amount of chelator added is intended to chelate a concentration of ions corresponding to 300 ppm hard water, which corresponds to 3 millimolar. Because water will often have a hardness of less than 300 ppm, leaving an excess of chelator, it is important to evaluate the stability of PAA with respect to the chelator. The excess chelator could cause increases in pH, which would decrease the amount of PAA present according to the reaction (Preparation, Properties, Reactions and Uses of Organic Peracids and their Salts, FMC Corporation, Inorganic Chemicals Division, New York, N.Y., 1964, p. 34):

$$CH_3COOOH+OH^- \rightarrow CH3COO^-+H_2O_2$$

Therefore, in anticipation of the worst case where soft water is used to prepare the solution from which the foam is generated, the stability of PAA in the presence of at least 3 millimolar of chelator was evaluated.

- 0.125 g of $Na_4EDTA$ and 0.170 g of 5% PAA were added to 100 g of DI water. PAA test strips (Merckoquant®, Merck KgaA, Darmstadt, Germany) showed that there was no PAA present immediately after preparation of the solution.
- 0.161 g of $Na_3EDTA$ and 0.170 g of 5% PAA were added to 100 g of DI water. PAA test strips showed that PAA was indeed present immediately after preparation of the solution (at least 50 ppm PAA). However, the PAA concentration decreased rapidly, and after ~5 minutes no PAA was detectable.
- 0.233 g of $Na_2EDTA$ and 0.170 g of 5% PAA were added to 100 g of DI water. PAA test strips showed that PAA was indeed present immediately after preparation of the solution (at least 50 ppm PAA). However, the PAA concentration decreased fairly rapidly, and after ~10 minutes no PAA was detectable.

The trend is in agreement with increasing pH causing a decrease in PAA stability. The PAA is most stable with $Na_2EDTA$ and least stable with $Na_4EDTA$ with $Na_3EDTA$ being intermediate; this is in agreement with the respective ability of these three chelators to increase the pH of DI water. According to pH test paper, these solutions made up in DI water in the absence of PAA give pH values of 4, 7.5, and 10 for $Na_2EDTA$, $Na_3EDTA$, and $Na_4EDTA$ respectively.

Although decreasing pH must be a contributing factor to the instability of PAA, a reaction of PAA and the chelator EDTA (regardless of the salt form) may also contribute to the instability of the PAA. However, we have not found any chelator in salt form in which PAA is stable in the presence of the chelator; examples include the pentasodium salt of diethylenetriaminepentaacetic acid and DEQUEST 2066.

Example 11

This Example describes the preparation of concentrates of various retention systems. The viscosity of the concentrates can be controlled by increase in anionic to non-ionic surfactant ratio, selection of surfactants and order of addition.

Concentrate Containing 20% SLS and 4% Lauryl Alcohol

To 200 g of sodium lauryl sulfate (STEPANOL* WA-100) and 40 g of lauryl alcohol (Aldrich Chemical Company 98%) was added 760 g of DI water. The thick slurry was heated and hand stirred at a temperature of ~50° C. until a clear light yellow solution formed. The solution was allowed to cool to room temperature overnight (~22° C.). At this temperature, the SLS/LA/DI water preparation is a white, homogenous solid. Heating to ~26° C. restores the preparation to a clear light yellow solution.

Concentrate Containing 15% SLS, 3% Lauryl Alcohol, and 7.5% Magnesium Sulfate-1

To 150 g of sodium lauryl sulfate (STEPANOL* WA-100), 75 g of anhydrous magnesium sulfate (J. T. Baker, Assay 100.0% magnesium sulfate) and 30 g of lauryl alcohol (Aldrich Chemical Company 98%) was added 745 g of DI water. The thick slurry was heated and hand stirred at a temperature of ~50° C. until a slightly turbid and slightly yellow solution formed. This solution was allowed to cool overnight to room temperature (~22° C.). At room temperature, this preparation remains a clear colorless liquid with a viscosity between 1300 cP and 1600 cP as measured on a Brookfield Dial Viscometer, Model RVF.

Concentrate Containing 15% SLS, 3% Lauryl Alcohol, and 7.5% Magnesium Sulfate-2

297.4 g of DI water was added to 519 g of STEPANOL WA-SPECIAL (28.9% aqueous SLS solution), and the solution was heated to ~50° C. with stirring. 153.6 g of magnesium sulfate heptahydrate (EM SCIENCE 98.0–102.0%) was added with stirring until it dissolved. Then, 30 g of lauryl alcohol (Aldrich Chemical Company 98%) was added, and stirred until a slightly turbid, colorless solution formed. This solution was allowed to cool overnight to room temperature (~22° C.). At room temperature, this preparation remains a clear colorless liquid with a viscosity between 1300 cP and 1600 cP as measured on a Brookfield Dial Viscometer, Model RVF.

Concentrate Containing 14.25% SLS, 3.15% Lauryl Alcohol, and 7.5% Magnesium Sulfate 321.85 g of DI water was added to 493.08 g of STEPANOL WA-SPECIAL (28.9% aqueous SLS solution), and the solution was heated to ~50° C. with stirring. 153.61 g of magnesium sulfate heptahydrate (EM SCIENCE 98.0–102.0%) was added with stirring until it dissolved. Then, 31.50 g of lauryl alcohol (Aldrich Chemical Company 98%) was added, and stirred until a slightly turbid, colorless solution formed. This solution was allowed to cool overnight to room temperature (~22° C.). At room temperature, this preparation remains a clear colorless liquid with a viscosity of 905 cP at 23.4° C. as measured on a Brookfield Dial Viscometer, Model RVF 6 days after preparation. However, 26 days after preparation, the viscosity increased to 1547 cP at 22.4° C. as measured on a Brookfield Dial Viscometer, Model RVF.

Concentrate Containing 15.5% SLS, 2.8% Lauryl Alcohol, and 7.5% Magnesium Sulfate-1

598.0 g of DI water was added to 1038.0 g of STEPANOL WA-SPECIAL (28.9% aqueous SLS solution), and the solution was heated to ~50° C. with stirring. 308 g of magnesium sulfate heptahydrate (EM SCIENCE 98.0–102.0%) was added with stirring until it dissolved. Then, 56 g of lauryl alcohol (Aldrich Chemical Company 98%) was added, and stirred until a slightly turbid, colorless solution formed. This solution was allowed to cool overnight to room temperature (~22° C.). At room temperature, this preparation remains a clear colorless liquid with a viscosity of 1587 cP at 22.3° C. as measured on a Brookfield Dial Viscometer, Model RVF.

Concentrate Containing 15.5% SLS, 2.8% Lauryl Alcohol, and 7.5% Magnesium Sulfate-2

159.6 g of DI water was added to 533.6 g of STEPANOL WA-SPECIAL (29.05% aqueous SLS solution), and the solution was heated to ~50° C. with stirring. 278.8 g of a 27% magnesium sulfate solution (The PQ Corporation) was added with stirring. Then, 28 g of lauryl alcohol (Aldrich Chemical Company 98%) was added, and stirred until a slightly turbid, colorless solution formed. This solution was allowed to cool overnight to room temperature (~22° C.). At room temperature, this preparation remains a clear colorless liquid with a viscosity of 852 cP at 22.3° C. as measured on a Brookfield Dial Viscometer, Model RVF.

Although the invention has been particularly shown and described with reference to certain embodiments, those skilled in the art will appreciate that various modifications and changes in form and details may be made without departing from the spirit and scope of the invention.

What is claimed is:

1. A sanitizer composition having improved surface retention, comprising:

(a) water;

(b) about 1 ppm to about 3000 ppm of an antimicrobial agent; and (c) a retention aid comprising about 0.01 wt % to about 3.0 wt % of a mixture of a non-ionic surfactant and an anionic surfactant;

wherein:

the non-ionic surfactant has a polar non-ionic group attached to a first alkyl group having 8 to 20 carbon atoms; the anionic surfactant has an anionic group attached to a second alkyl group having 8 to 20 carbon atoms; and the ratio of the non-ionic surfactant to the anionic surfactant is about 0.1:1 to about 0.5:1.

2. The composition of claim 1 additionally comprising (d) a magnesium ion source.

3. The composition of claim 1 wherein the magnesium ion source (d) is a magnesium salt.

4. The composition of claim 1 wherein the antimicrobial agent is selected from organic peracids, peracid generators, persulfates, peroxides, percarbonates, perchlorates, chlorine dioxide, hypochlorites, phenolics, iodine, iodides, iodophors, and mixtures of any two or more thereof.

5. The composition of claim 1 in which the first and second alkyl groups are straight chain, the first alkyl group is substituted with the non-polar non-ionic group on a terminal carbon atom, and the second alkyl group is substituted with the anionic group on a terminal carbon atom.

6. The composition of claim 5 in which the first and second alkyl groups have 10 to 18 carbon atoms.

7. The composition of claim 5 in which the first and second alkyl groups have 11 to 16 carbon atoms.

8. The composition of claim 6 in which the first and second alkyl groups have the same or substantially the same number of carbon atoms.

9. The composition of claim 1 in which the non-ionic surfactant is lauryl alcohol and the anionic surfactant is sodium lauryl sulfate, magnesium lauryl sulfate or mixture thereof.

10. The composition of claim 1 in which the antimicrobial agent is an organic peracid or a mixture of organic peracids.

11. The composition of 10 in which the organic peracid is peracetic acid.

12. The composition of claim 10 in which the amount of organic peracid or mixture of organic peracids, is about 25 ppm to about 2600 ppm.

13. The composition of claim 10 in which the amount of organic peracid acid or mixture organic peracids, is about 75 ppm to about 1000 ppm.

14. The composition of claim 1 in which the antimicrobial agent is peracetic acid or a mixture of peracetic acid and another organic peracid, and the retention aid comprises about 0.05 wt % to about 2.0 wt % of the composition.

15. The composition of claim 1 in which the antimicrobial agent is peracetic acid or a mixture of peracetic acid and another organic peracid, and the retention aid comprises about 0.1 wt % to about 0.5 wt % of the composition.

16. The composition of claim 1 in which the antimicrobial agent is peracetic acid or a mixture of peracetic acid and another organic peracid, and the ratio of the non-ionic surfactant to the anionic surfactant is about 0.12:1 to about 0.3:1.

17. The composition of claim 1 in which the antimicrobial agent is peracetic acid or a mixture of peracetic acid and another organic peracid, the non-ionic surfactant is lauryl alcohol, and the anionic surfactant is sodium lauryl sulfate, magnesium lauryl sulfate or a mixture thereof.

18. The composition of claim 17 additionally comprising a magnesium salt in an amount of about 0.01 wt % to about 3.0 wt %.

19. A method for sanitizing a surface, comprising applying a sanitizer composition of claim 1 to the surface for a time sufficient to sanitize the surface.

20. The method of claim 19 in which the surface is metallic, concrete, plastic, or any combination thereof.

21. The method of claim 19 in which the surface is an animal carcass, a fruit or vegetable, or a meat, poultry or seafood product.

22. The method of claim 19 in which the sanitizer composition is applied as a foam or film.

23. A retention aid concentrate for admixture with an antimicrobial composition, comprising a mixture of non-ionic surfactant and an anioniconic surfactant, in a ratio of about 0.1:1 to about 0.5:1; wherein:

the non-ionic surfactant has a polar non-ionic group attached to a first alkyl group having 8 to 20 carbon atoms, and the anionic surfactant has an anionic group attached to a second alkyl group having 8 to 20 carbon atoms.

24. The concentrate of claim 23 wherein the first and second alkyl groups are straight chain, the first alkyl group is substituted with the non-polar group on a terminal carbon atom, and the second alkyl group is substituted with the anionic group on a terminal carbon atom.

25. The concentrate of claim 23 wherein the first and second alkyl groups have 10 to 18 carbon atoms.

26. The concentrate of claim 23 wherein the first and second alkyl groups have 11 to 16 carbon atoms.

27. The concentrate of claim 25 wherein the first and second alkyl groups have the same or substantially the same number of carbon atoms.

28. The concentrate of claim 23 in which the non-ionic surfactant is lauryl alcohol and the anionic surfactant is sodium lauryl sulfate, magnesium lauryl sulfate or a mixture thereof.

29. The concentrate of claim 28 further comprising a magnesium salt.

30. The concentrate of claim 23 in which the magnesium ion source is magnesium sulfate, and the ratio of the magnesium sulfate to the non-ionic surfactant and anionic surfactant is about 0.02:1 to about 5:1.

31. A sanitizer kit comprising a first part and a second part, in which the first part comprises an aqueous solution or dispersion of an antimicrobial agent, and the second part comprises a retention aid as defined in claim 1.

32. The kit of claim 31 in which the antimicrobial agent is peracetic acid or a mixture of peracetic acid and another organic peracid, in an amount of about 5 wt % to about 15 wt % of the first part.

33. The kit of claim 32 in which the non-ionic surfactant is lauryl alcohol and the anionic surfactant is sodium lauryl sulfate, magnesium lauryl sulfate or mixture thereof.

34. The kit of claim 31 further comprising, in the second part, a magnesium ion source.

35. The kit of claim 34 in which the magnesium ion source is a magnesium salt.

* * * * *

UNITED STATES PATENT AND TRADEMARK OFFICE

CERTIFICATE OF CORRECTION

PATENT NO. : 6,828,294 B2
DATED : December 7, 2004
INVENTOR(S) : Kenneth E. Kellar et al.

It is certified that error appears in the above-identified patent and that said Letters Patent is hereby corrected as shown below:

Column 28,
Line 14, following "atoms" insert -- , the concentrate further comprising a magnesium ion source. --

Signed and Sealed this

Twenty-second Day of March, 2005

JON W. DUDAS
*Director of the United States Patent and Trademark Office*